US007798320B2

(12) United States Patent
Pham

(10) Patent No.: US 7,798,320 B2
(45) Date of Patent: Sep. 21, 2010

(54) AROMATIC POCKET TEAR TAPE FOR CIGARETTE PACK

(75) Inventor: Xuan Minh Pham, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 1146 days.

(21) Appl. No.: 11/443,912

(22) Filed: May 31, 2006

(65) Prior Publication Data

US 2006/0278543 A1 Dec. 14, 2006

Related U.S. Application Data

(60) Provisional application No. 60/689,321, filed on Jun. 10, 2005.

(51) Int. Cl.
*B65D 65/26* (2006.01)

(52) U.S. Cl. ..... 206/264; 229/87.05; 229/87.13

(58) Field of Classification Search ..... 206/264, 206/265, 266, 271, 273; 229/87.05, 87.13, 229/87.18

See application file for complete search history.

(56) References Cited

U.S. PATENT DOCUMENTS

| | | | | |
|---|---|---|---|---|
| 3,773,248 | A | 11/1973 | Cecil et al. | |
| 3,779,848 | A | 12/1973 | Maierson | |
| 4,493,869 | A | 1/1985 | Sweeny et al. | |
| 4,528,226 | A | 7/1985 | Sweeny | |
| 4,717,017 | A | 1/1988 | Sprinkel, Jr. et al. | |
| 4,720,423 | A | 1/1988 | Fraser | |
| 5,249,676 | A * | 10/1993 | Ashcraft et al. | 206/264 |
| 5,542,529 | A * | 8/1996 | Hein et al. | 206/245 |
| 5,938,018 | A | 8/1999 | Keaveney et al. | |
| 6,541,052 | B1 | 4/2003 | Rohleder et al. | |
| 2001/0013476 | A1 * | 8/2001 | Thoeren et al. | 206/264 |
| 2004/0018278 | A1 * | 1/2004 | Popplewell et al. | 426/132 |
| 2007/0023301 | A1 * | 2/2007 | Pham | 206/264 |
| 2007/0104902 | A1 * | 5/2007 | Popplewell et al. | 428/34.2 |

FOREIGN PATENT DOCUMENTS

| | | |
|---|---|---|
| GB | 2 319 511 | 5/1998 |
| WO | WO-9742098 A1 | 11/1997 |

* cited by examiner

*Primary Examiner*—Jacob K Ackun, Jr.
(74) *Attorney, Agent, or Firm*—Connolly Bove Lodge & Hutz LLP

(57) ABSTRACT

A sealed pocket formed on a package overwrap, such as the overwrap around a cigarette package, is provided with an aromatic. The pocket containing the aromatic is placed proximate to a tear strip. As the tear strip is pulled along and removed from the package the pocket is opened, the aromatic is exposed to the air and an aroma is released.

9 Claims, 4 Drawing Sheets

AROMATIC POCKET TEAR TAPE FOR CIGARETTE PACK

CROSS REFERENCE RELATED TO APPLICATION

The present application claims the benefit of provisional application Ser. No. 60/689,321, filed Jun. 10, 2005, for all useful purposes, and the specification and drawings thereof are included herein by reference.

BACKGROUND OF THE INVENTION

Packaging for cigarettes is generally well known. A cigarette pack typically includes a foil layer wrapped around the cigarettes in the pack; paper or paperboard wrapped around the foil layer; and a layer of overwrap, generally comprising a metallic film or a transparent film of a polymeric material such as polyethylene, wrapped and sealed around the entire pack to maintain cigarette freshness. A thin strip of material, generally consisting of a polymer such as polypropylene, is provided on the inner side of the film before the film is wrapped around pack. This strip of material, called a "tear strip," is usually denser and stronger than the film and usually projects from the wrapping at a side of the pack and is pulled to slit open the polymeric wrapping.

U.S. Pat. No. 4,717,017 to Sprinkel, Jr. et al. teaches the use of a receptacle that can be outside the polymeric film of a cigarette pack or between the film and the tear strip. The receptacle is filled with an aromatic substance. When the tear strip is pulled to slit the polymeric film, the receptacle is also slit open, releasing the substance contained therein for dispersal into the air or onto the cigarettes in the pack.

Currently, there is a need in the art to provide an aromatic substance to the surface of a package film by a continuous method. Furthermore, there is a need and desire to provide discrete pockets of aromatic substances that release aroma when the tear strip is pulled along the package.

SUMMARY OF THE INVENTION

It is an object of this invention to provide a cigarette pack or other package that releases an aroma of freshness upon opening. It is also an object of the invention to provide an aromatic-pocket-label which can be applied on the outerwrap of a cigarette pack, and which can be easily opened by the tear-strip on a cigarette pack.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF A PREFERRED EMBODIMENT

Referring with more particularity to the drawings, FIGS. 1-25 illustrate preferred embodiments of the invention.

First Embodiment

Figure 1:
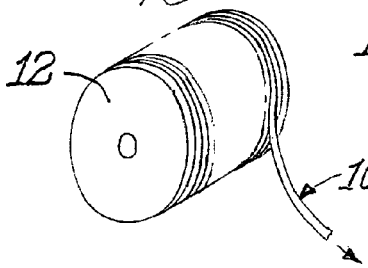
FIG. 1 shows a perspective view of a wide tear tape on a bobbin with aroma and adhesive applied to the tape.
Figure 2:
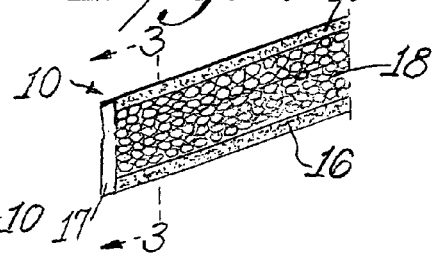
FIG. 2 shows an enlarged fragmental perspective view of the tear tape from the backside thereof, according to one embodiment of the present invention.

According to a first embodiment of the present invention, a wide tear tape 10 is provided with at least three distinct regions. As shown in FIG. 2, tape 10 may be formed from a substrate 17 with multiple regions with an adhesive surface 16, which may extend along the edges or toward the periphery of substrate 17. Tape 10 is also formed with an aromatic coating 18, in a third, central region. Aromatic coating 18 may be applied to substrate 17 according to any known manner, such as by spraying, dipping or other material or chemical transfer means. As shown in FIG. 1, tape 10 may be stored on bobbin 12 before or after forming adhesive surfaces 16 and aromatic coating 18 so that the tape can be supplied to a package wrapping apparatus (not shown).

Figure 3:
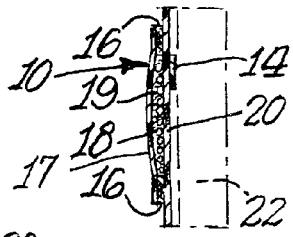
FIG. 3 shows a cross-sectional view in elevation taken along line 3-3 of FIG. 2.

As show in FIG. 3, a narrow tear strip 14 is positioned on the inside surface of film 20 on the side facing a package 22 (shown in phantom), which may be a cigarette pack. Tape 10 is applied to a second side or outside surface of film 20, which is opposite to and aligned with strip 14. Adhesive 16 bonds tape 10 to film 20, thereby forming a pocket 19 or numerous discreet pockets (not shown) that seal in aromatic coating 18.

Tear strip 14 and tear tape 10 may be of a similar material, such as a polymer. Tear strip 14 may be made of a material that is stronger than tear tape 10 to ensure that tear strip 14 will be able to slice through both outerwrap 20 and the tear tape 10. For instance, tear strip 14 may be polypropylene, while tear tape 10 may be polyethylene. However, any materials that have the desired attributes may be used.

Figure 4:
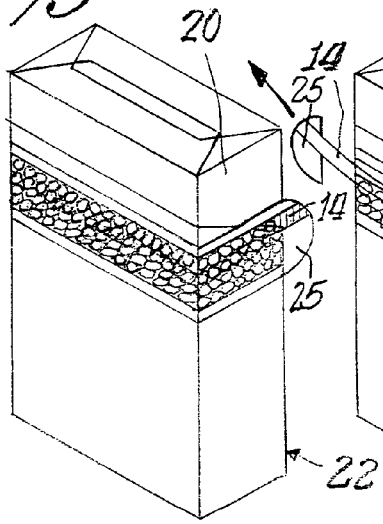
FIG. 4 shows a perspective view of a hinge top cigarette pack with tear tape, according to a first embodiment of the present invention.

After the tape 10 and strip 14 are attached to film 20, film 20 may be cut into discrete sheets (not shown) and wrapped around packages 22, as is well known in the art of cigarette packaging to produce the wrapped package shown in FIG. 4. Thus, the package is sealed, and the freshness of enclosed articles, such as cigarettes, may be maintained.

Figure 5:
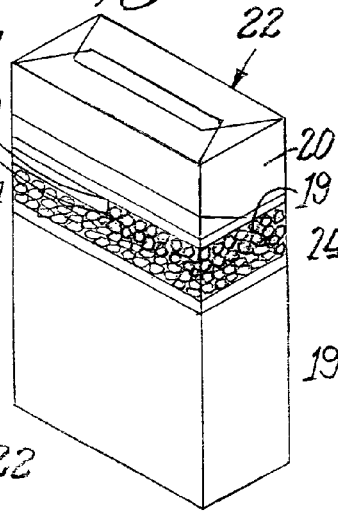
FIG. 5 shows a thin tear strip being pulled from inside out to expose an aroma pocket.
Figure 6:
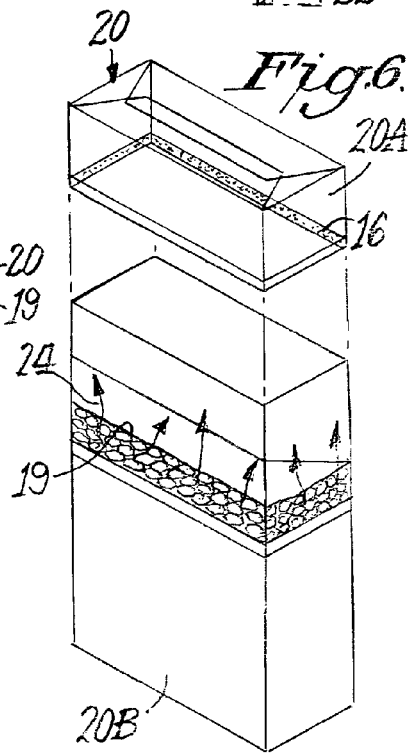
FIG. 6 illustrates aroma being released from an attached aroma pocket.

As shown in FIG. 5, the tear strip 14 may be pulled across the surface of package 22 in order to slice through outerwrap film 20 and the tape 10. Thus, as shown in FIG. 6, the upper portion 20A of film 20 is separated from the lower portion 20B of film 20 and aroma is released from the aroma pocket(s) 19 in the direction of arrows 24.

Figure 7:
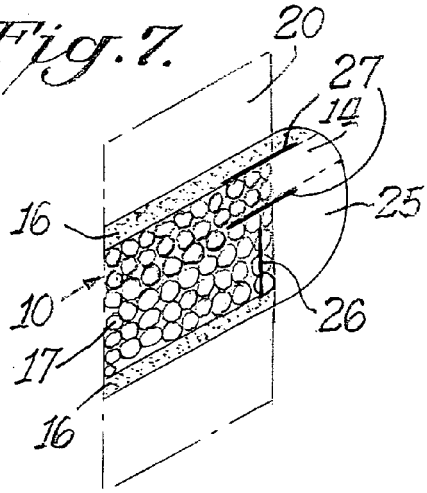
FIG. 7 shows a fragmental perspective view showing cuts through the wide tear tape for removal by and with the thin tear strip when the cigarette pack is opened.

Cuts 26 and 27, shown in FIG. 7, may be provided on tape 10 to facilitate the slicing and separation operation. As a tear tab 25 is pulled, an over-cut 26 separates the tab 25 from a portion of the tape 10. As the tab 25 and the strip 14 are pulled, primed cuts 27 guide the tearing process and facilitate propagation of the opening through both the film 20 and the tape 10. Strip 14 tears through tape 10 with the assistance of the adhesive 16, which helps to constrain tape 10 to the outer surface of film 20 by virtue of the bond formed at both sides of the tape 10. The torn line creates the opening between the film 20 and tape 10. This open gap serves as a passage for the trapped aroma to escape from pocket 19.

Once the aroma is released it may linger with the package 22 because the aromatic coating is provided on the lower portion of film 20, which is typically retained by the user. The top portion of film 20, which may still have a portion of tape 10 adhered by adhesive 16 is typically discarded by the user. Thus, according to the first embodiment an aromatic is released and may be retained with the package to a certain degree due to the fact that a majority of the tape 10 provided with the aromatic coating is retained with the package 22.

Second Embodiment

Figure 8:
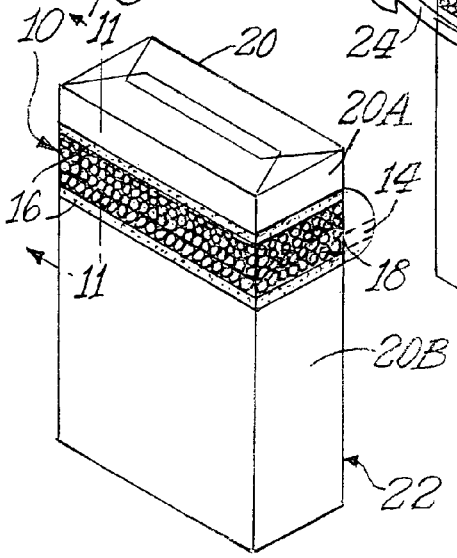
FIGS. 8-10 each show a perspective view of a hinge top cigarette pack with tear tape according to a second embodiment of the present invention, in which aroma-coating on the top part of the overwrap is totally removed, which gives off a short burst of aroma.
Figure 9:
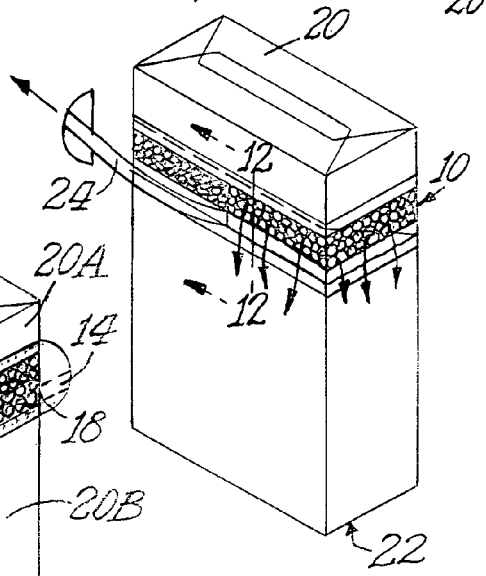
Figure 10:
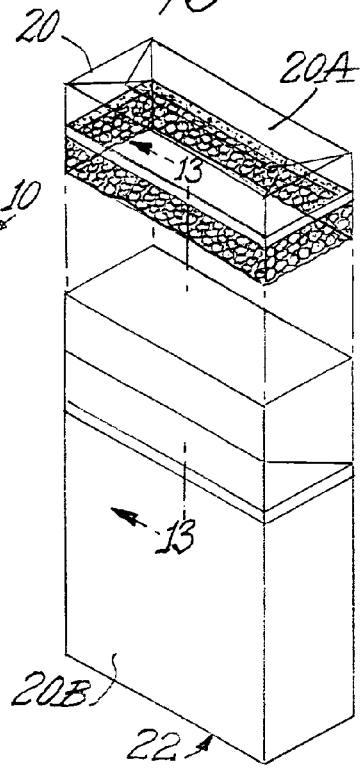

According to a second embodiment of the present invention shown in FIGS. 8-10, the same wide tear tape 10 described in the first embodiment is provided on a package 22, but the released aroma does not linger with package 22 because the aromatic coating is provided on the upper portion 20A of film 20, which is typically discarded by the user after opening. The lower portion 20B of film 20, which may be retained by the user, may still have a portion of tape 10, but the retained portion of tape 10 with the adhesive 16 does not contain an appreciable amount aromatic coating 18. Thus, according to the second embodiment an aroma is experienced only for a short duration of time.

Figure 11:
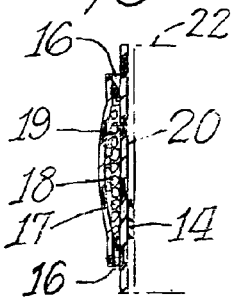
FIGS. 11-13 show cross sectional views in elevation of the tear tape shown in FIGS. 8-10, respectively.

Similar to the first embodiment, a tear strip 14 is positioned between the outerwrap film 20 and package 22 (shown in phantom) as shown in FIG. 11. Tape 10 is attached to the outside of film 20, opposite strip 14. Adhesive 16 bonds tape 10 to film 20, thereby forming a pocket or numerous discreet pockets that seal in the aromatic coating 18. As shown FIG. 8, tape 10 is aligned with strip 14 so that most, if not all of the aromatic coating 18 is situated on the upper portion 20A of film 20.

As shown in FIGS. 9 and 10, strip 14 may be pulled across the surface of package 22 in order to slice through film 20 and tape 10. As shown in FIG. 10, the upper portion 20A of film 20 can be separated from the lower portion 20B of film 20 to thereby release aroma from the aroma pocket or pockets in the direction of arrows 24A. Thus, as shown in FIG. 12, the aroma can be released according to the second embodiment in manner similar to the first embodiment.

Figure 12:
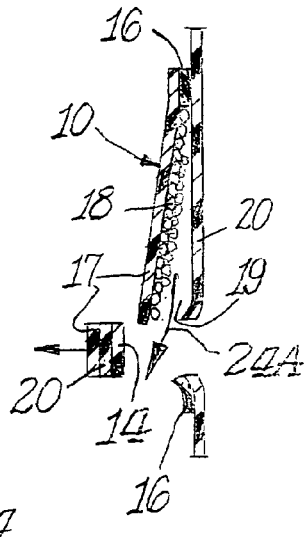

As shown in FIG. 12, tear strip 14 tears through the outerwrap 20 and the tape 10 with the assistance of the adhesive 16, which helps to constrain tape 10 to the outer surface of film 20 by virtue of the bond formed at both sides of the tape 10. In such a situation, the torn line creates the opening 19 between the film 20 and outer substrate 17, and this opening 19 serves as a passage for the trapped aroma to escape as shown in FIG. 9.

Figure 13:
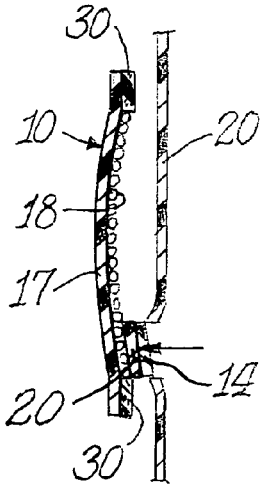

Alternatively, as shown in FIG. 13, strip 14 may entirely lift and separate tape 10 from film 20 by severing the adhesive bond between tape 10 and film 20 to expose the aromatic 18 and release the aroma. A less aggressive adhesive 30 may be used to attach substrate 17 to film 20 as shown in FIG. 13. According to this alternative, tape 10 is not as strongly adhered to film 20. As strip 14 is pulled across the package 22 (not shown), the opening propagates through film 20 and tape 10 is entirely separated from film 20 along with the tear strip.

Figure 14:
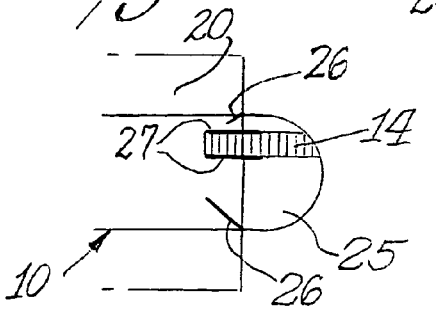
FIG. 14 shows a fragmental perspective view showing the tear strip and cuts through the tear tape.

Over-cuts 26, shown in FIG. 14, may be provided on tape 10 to facilitate the separation operation. As a tear tab 25 is pulled, the over-cuts 26 separate the tab 25 from a portion of the tape 10. As the tab 25 and the strip 14 are pulled, primed cuts 27 guide the tearing process and facilitate propagation of the opening either by tearing through or lifting tape 10.

It is expected that tape 10, strip 14, and film portion 20A will be discarded shortly after opening. Thus, an aroma is experienced for only a brief period of time and does not remain with the package.

Figure 14A:
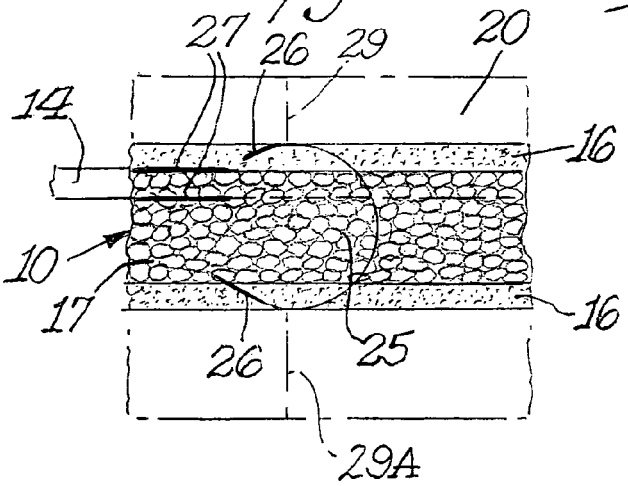
FIG. 14A is a perspective view similar to FIG. 14 showing a continuous sheet cut into individual pieces, one for overwraping a cigarette pack.

FIG. 14A shows a continuous strip of overwrap 20 cut into individual pieces along transverse cut lines 29 and 29A and also along the outline of the tear tab 25. The inside tear tape 10 and narrow tear strip 14 are continuous on opposite sides of the outerwrap. Cuts 29 and 29A cut the overwrap 20 and tear tape 10 while the cut along the outline of the tear tab cuts the tear strip 14.

Third Embodiment

Figure 15:
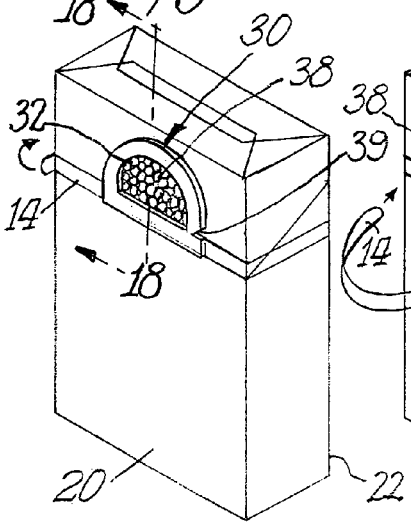
FIGS. 15-17 show perspective views of a hinge top cigarette pack with tear tape according to a third embodiment of the present invention, in which aroma is applied as a label with a pocket that gives off a short burst of aroma as the tear strip is removed.
Figure 16:
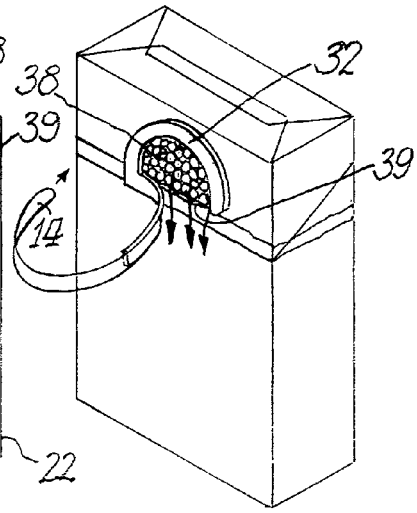
Figure 17:
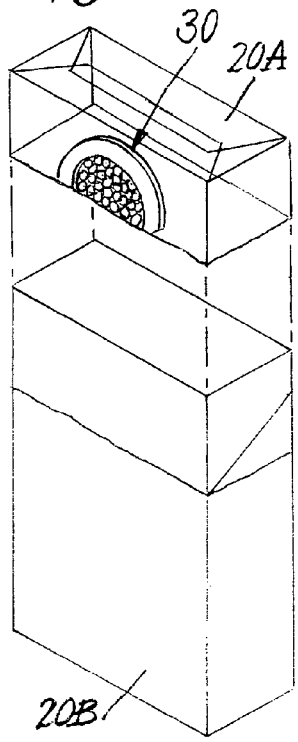

FIGS. 15-17 illustrate the present invention according to a third embodiment, in which aroma is applied as a label with a pocket that gives off a short burst of aroma as the tear strip is removed.

Figure 18:
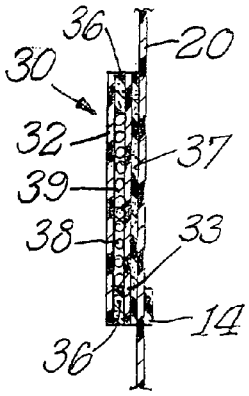
FIG. 18 shows a cross sectional view in elevation of the tear tape taken along line 18-18 of FIG. 15.
Figure 20:
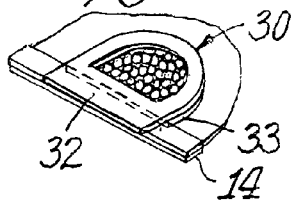
FIG. 20 shows a perspective view of a modified aromatic label of the third embodiment of the invention.
Figure 22:
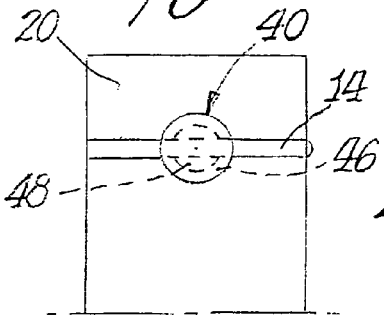
FIG. 22 shows a front elevational view of a fourth embodiment of the present invention in which a sealed aromatic label is applied on the outer surface of the overwrap and entirely removed with the tear strip upon opening the cigarette pack.

According to the third embodiment, a discrete pocket is formed by adhering two layers of material to each other or to film 20 to form a label 30. As shown in FIGS. 18 and 20, a top layer 32 of encapsulating material is attached to a bottom layer 33 of encapsulation material. The two layers can be held together by an adhesive 36 or by any other conventional manner of bonding, and the two layers 32 and 33 are bonded to film 20 by aggressive adhesive 37. Either or both layers 32 and 33 may be provided with an aromatic substance 38 on the sides facing each other in the manner discussed above with respect to the first and second embodiments. Layers 32 and 33 may totally encapsulate the aromatic substance 38 or layer 32 may extend beyond layer 33 to form a pocket that is enclosed by attaching the overlapping portion of layer 32 to film 20.

Label 30 can be attached to film 20 so that a portion of the label is directly opposite tear strip 14. Label 30 can also be provided with a notch or nick 39 to facilitate the opening the pocket containing the aroma. If layer 32 overlaps 33, as shown in FIG. 20 and is attached directly onto film 20, only layer 32 needs be notched to facilitate its tearing. If layer 32 does not overlap 33, both layers can be notched so that a portion of the bonded layers 32 and 33 can be removed to expose the pocket 39 and release aroma from the aromatic coating 38 as shown in FIG. 16. As shown in FIG. 17, the top portion 20A of film 20 can then be discarded.

Figure 19:
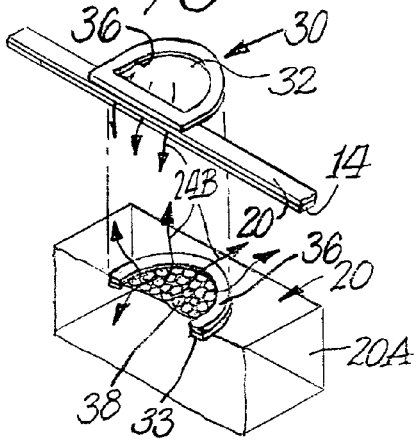
FIG. 19 shows an exploded perspective view of the two part label of the third embodiment of the invention.

Alternatively, layer 32 may be totally removed from label 30 during opening of the package, as shown in FIG. 19. In such a case, layers 32 and 33 can be joined by an adhesive that is less strong or less aggressive than the adhesive that attaches label 30 to film 20. An overlapping portion of 32, such as is shown in FIG. 20 can be provided with an adhesive that is more aggressive than adhesive 36 bonding layers 32 and 33 together. For example, the adhesive on the overlapping portion of layer 32 could be as aggressive as the adhesive attaching the label to the film 20. According to this alternative of the third embodiment, no notch is required. As shown in FIG. 19, when the tear strip 14 is pulled, layer 32 can be removed from layer 33 to thereby release aroma. Thus, aroma 24B may be more efficiently released.

Figure 21:
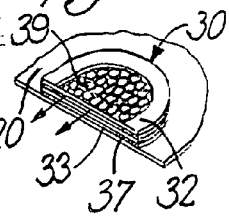
FIG. 21 is a view similar to FIG. 20 but showing the label open to release the flavor.

As shown in FIGS. 20 and 21, label 30 can be applied to film 20 before or after film 20 is wrapped around package 22. As strip 14 is pulled across label 30 aroma may be released. The portion of the label 30 not attached directly opposite the strip 14 may be placed predominantly over the upper portion 20A of film 20 or predominantly over the lower portion 20B of film 20 in order to gain desired aroma retention characteristics discussed above with respect to the first and second embodiments.

Fourth Embodiment

FIGS. 22-25 show a fourth embodiment of the present invention according to which an aromatic coating 48 is formed on a label 40.

Figure 24:
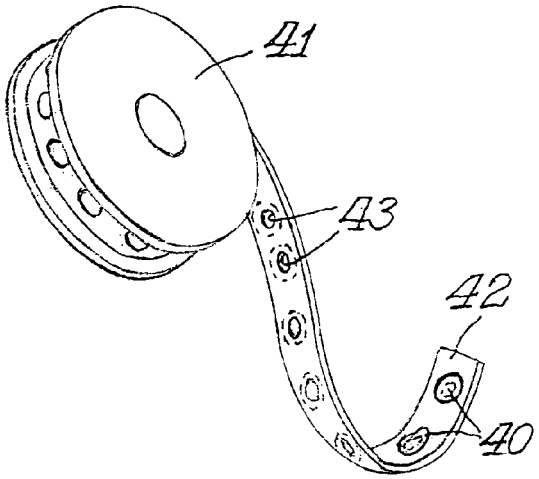
FIG. 24 shows a perspective view of a bobbin of continuous tape having labels on one side and register holes on the other side to receive aroma coating.
Figure 25:
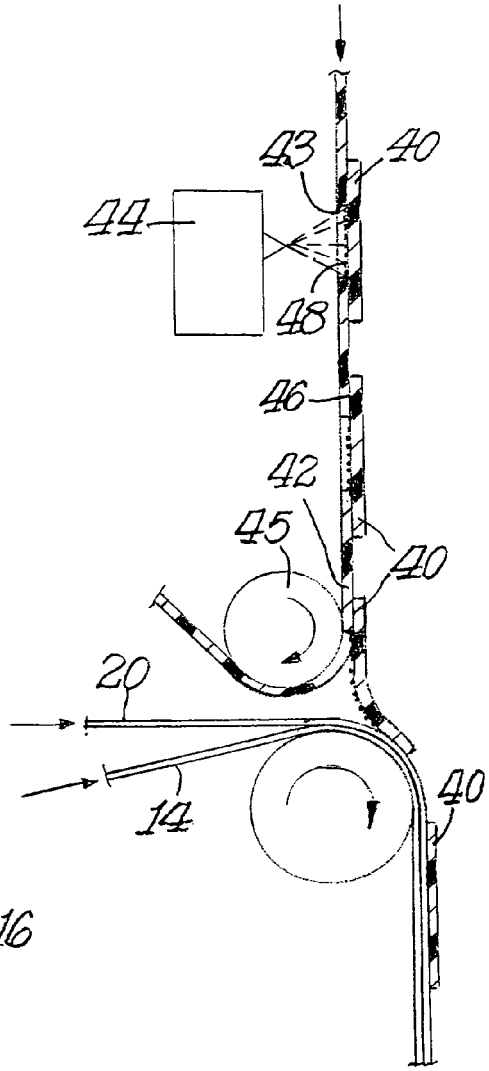
FIG. 25 shows a diagrammatic-sectional view showing the method of applying aromatic coating to the labels in line with an overwrap machine, and attaching the labels to the outside of the overwrap and tear strips to the inside of the overwrap simultaneously.

As shown in FIG. 24, a bobbin 41 of continuous tape 42 may be provided with labels 40 on one side and register holes 43 on the other side to receive aroma coating. As shown in FIG. 25, an applicator 44 may provide aroma coating 48 through register holes 43 to labels 40 just before it is peeled off from the tape 42 and applied to the overwrap 20.

Labels 40 are advanced toward film 20 by wheel 45. As a label 40 comes in close proximity with film 20 the edge of label 40 becomes separated from tape 42 and label 40 attaches to film 20. In this manner aromatic 48 becomes encapsulated between film 20 and label 40. Labels 40 are fed so that at least a portion of the label 40 is located directly opposite tear strip 14 on film 20. Film 20 is then cut into discrete sheets and wrapped around packages 22 with the attached labels 40 on the outside according to well known methods to produce the wrapped package shown in FIGS. 22 and 23.

Figure 23:
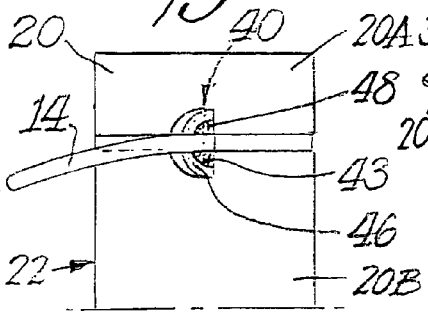
FIG. 23 shows a front elevational view of the fourth embodiment of the present invention in which the aromatic label in the form of a circle is exposed by removing the tear strip.

Adhesive 46 for attaching label 40 to film 20 may be provided to be strong enough to encapsulate the aromatic, but weak enough that the label can be easily removed by tear strip 14. As shown in FIG. 23, when tear strip 14 is pulled across the surface of package 22, upper portion 20A of film 20 may be separated from lower portion 20B. As the strip is pulled along the label, the label is entirely removed from the surface of film 20. Thus, aromatic is exposed to the air and an aroma is released.

Alternatively, adhesive 46 for attaching label 40 to film 20 may be provided to be strong enough that when tear strip 14 is pulled across the surface of package 22, tape 14 slices through label 40 to expose the aromatic coating 48 and release an aroma.

It should be noted that labels 30 and 40 can be applied to film 20 before or after the film is wrapped around package 22. The labels could be printed to contain advertising information. Such a label could be placed on the package 22 by the manufacturer or retailer for any promotional purpose.

The foregoing description of the invention illustrates and describes the present invention. Additionally, the disclosure shows and describes only the preferred embodiments of the invention, but it is to be understood that the invention is capable of use in various other combinations, modifications, and environments and is capable of changes or modifications within the scope of the inventive concept as expressed herein, commensurate with the above teachings, and/or the skill or knowledge in the art of packaging and, more particularly cigarette wrapping.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A product comprising a film wrapped around a package, wherein a tear strip is formed on the side of the film facing the package and a tear tape is attached to the side of the film facing away from the package, the tear tape being aligned with the tear strip, and wherein the tear tape contains small cuts that define a tab to facilitate slicing of the tear tape and film when pulling the tear strip along the surface of the package.

2. The product of claim 1 in which the tear tape comprises a substrate comprising an aroma coating and an adhesive coating, wherein aroma is released by pulling the tear strip across tear tape to expose the aroma coating.

3. The product of claim 2 in which the aroma is released from an aroma pocket.

4. The product of claim 3, in which the tear tape is retained on a lower portion of the film.

5. The product of claim 3, in which the tear tape is retained on an upper portion of the film.

6. A product comprising:

a film wrapped around a package;

a label comprising multiple layers encapsulating an aromatic substance;

a first adhesive bonding the label to the film;

a tear strip for slicing through the film and the label so that the aromatic substance is released from the label;

at least a portion of the label being located on the outside of the film directly opposite from the tear strip, and wherein the portion is an edge of the label;

a first outside layer of the label being attached to a second outside layer of the label using a second adhesive, and the second outside layer being bonded to the film with the first adhesive; and wherein the first adhesive is stronger than the second adhesive.

7. A product comprising:

a film wrapped around a package;

a label comprising multiple layers encapsulating an aromatic substance;

a first adhesive bonding the label to the film;

a tear strip for slicing through the film and the label so that the aromatic substance is released from the label;

at least a portion of the label being located on the outside of the film directly opposite from the tear strip, and wherein the portion is an edge of the label;

a first outside layer of the label being attached to a second outside layer of the label using a second adhesive, and the second outside layer being bonded to the film with the first adhesive; and wherein a portion the first outside layer overlaps a portion of the second outside layer, wherein the portion of the first outside layer is the portion of the label located on the outside of the film directly opposite from the tear strip and the portion of the first outside layer overlapping the second layer is provided with a third adhesive; and wherein the third adhesive is stronger than the second adhesive.

8. A product comprising:

a film wrapped around a package;

a label attached to the film, the label comprising:

a support layer, an adhesive formed on a first side and along the edge of the support layer to attach the label to the film, and an aromatic substance formed on the first side of the support layer surrounded by the adhesive and encapsulated by the attachment of the label to the film; and a tear strip for slicing through the film and for separating at least a portion of the label from the film so that the aromatic substance is released from the label.

9. A method for attaching an aromatic label to a package comprising:

providing a carrier tape with an opening;

attaching a label to the carrier tape so that the label contacts the carrier tape around the opening and the label covers the opening, applying an aromatic substance to the label through the opening in the carrier film, transferring the label from the carrier tape to a film, and wrapping the package with the film.

* * * * *